United States Patent [19]

DeNora et al.

[11] 4,138,295

[45] Feb. 6, 1979

[54] PROCESS AND APPARATUS FOR DOWNWARD RECYCLING OF THE ELECTROLYTE IN DIAPHRAGM CELLS

[75] Inventors: Vittorio DeNora, Nassau, The Bahamas; Oronzio de Nora, Milan, Italy

[73] Assignee: Diamond Shamrock Technologies S.A., Geneva, Switzerland

[21] Appl. No.: 878,750

[22] Filed: Feb. 17, 1978

Related U.S. Application Data

[63] Continuation of Ser. No. 754,024, Dec. 23, 1976, abandoned.

[51] Int. Cl.[2] ..... C25B 1/16; C25B 1/26; C25B 11/02; C55B 11/03

[52] U.S. Cl. ..... 204/98; 204/128; 204/256; 204/258; 204/266; 204/270; 204/278

[58] Field of Search ..... 204/98, 128, 256, 258, 204/266, 270, 278

[56] References Cited

U.S. PATENT DOCUMENTS

| | | | |
|---|---|---|---|
| 3,910,827 | 10/1975 | Raetzsch et al. | 204/128 |
| 3,930,151 | 12/1975 | Shibata et al. | 204/258 |

FOREIGN PATENT DOCUMENTS

| | | | |
|---|---|---|---|
| 2425817 | 12/1975 | Fed. Rep. of Germany | 204/98 |

*Primary Examiner*—R. L. Andrews
*Attorney, Agent, or Firm*—Hammond & Littell

[57] ABSTRACT

An alkali chlorine diaphragm cell such as is constructed in a conventional manner whereby evolved gaseous chlorine rises in the pool of alkali metal chloride solution is provided with recycling means to recycle the solution from an upper level of the solution to a predetermined lower level of the solution adjacent the cell bottom, a plurality of spaced conduits are preferably provided for this purpose.

The downward recirculation of the electrolyte through these conduits is induced by the upward movement of the electrolyte caused by the gaseous chlorine rising in the electrolyte outside the conduits. These conduits advantageously are located at or near anode surfaces and prevent or restrain lateral movement of recycled electrolyte until the recycled electrolyte reaches such lower level usually adjacent the bottom of the anolyte chamber. The circulation is preferably conducted as a plurality of spaced downward streams, each stream being between a pair of cathode elements and discharging into the space between an anode element and at least one of the cathode elements of the pair.

This invention is concerned with an improved electrolytic cell for electrolysis of aqueous alkali metal halide solutions to produce the corresponding halogen and an improved method for operating cells used in such electrolysis. Alkaline compounds, notably sodium hydroxide, are produced in conjunction with chlorine production.

37 Claims, 7 Drawing Figures

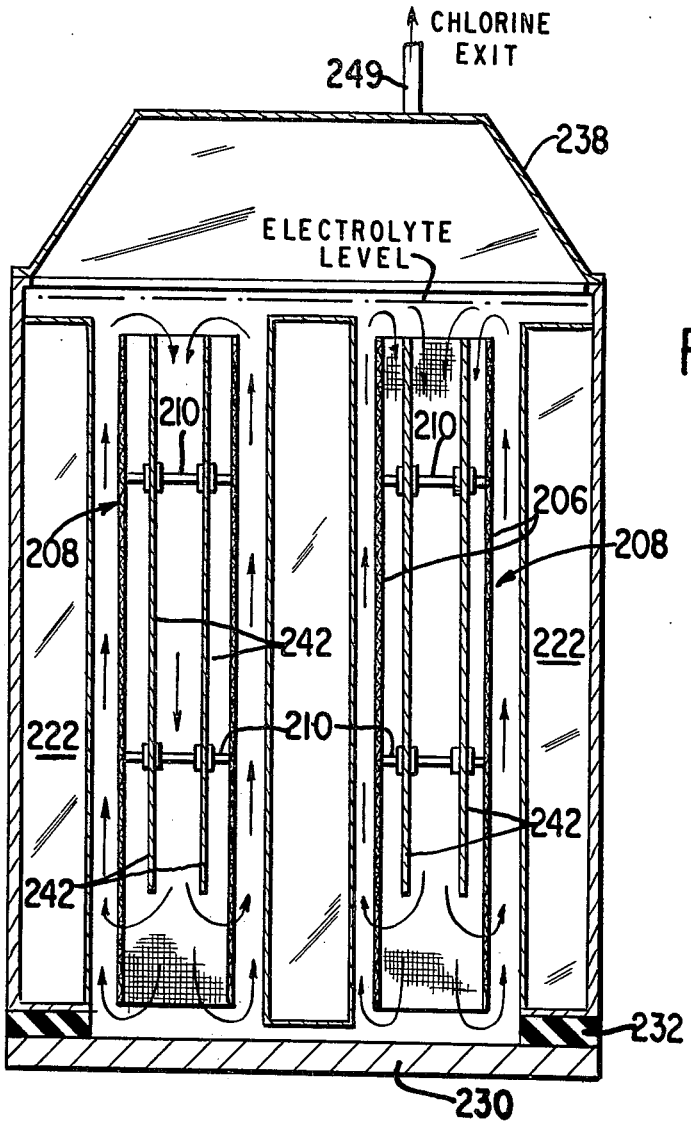
FIG. 5
FIG. 6
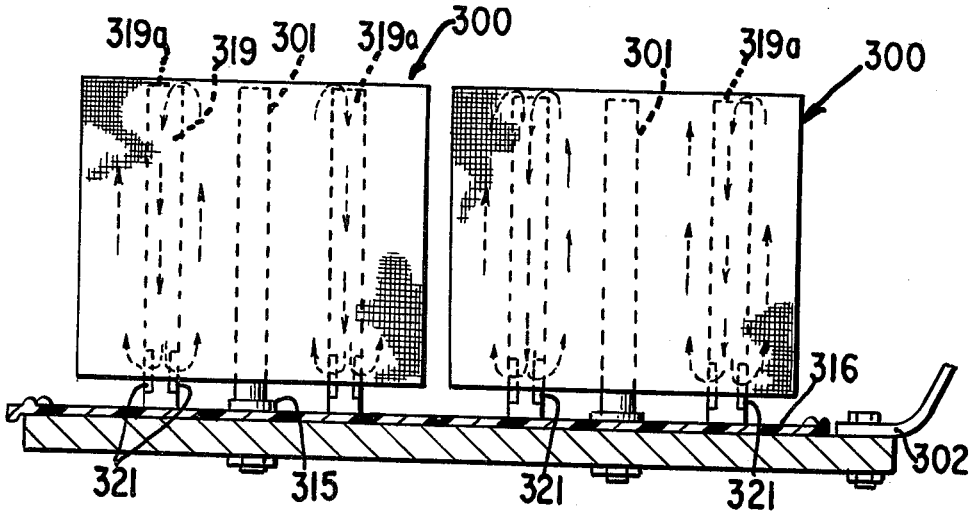

PROCESS AND APPARATUS FOR DOWNWARD RECYCLING OF THE ELECTROLYTE IN DIAPHRAGM CELLS

This is a continuation, of Ser. No. 754,024, filed Dec. 23, 1976 now abandoned.

STATE OF THE ART

The conventional method of producing chlorine is to electrolyze an aqueous solution of sodium chloride. A large amount of chlorine is produced in diaphragm cells which essentially comprise a cell tank having one or a plurality of hollow parallel foraminous iron cathode elements mounted therein and opposing anode elements which anode elements are located in an anolyte chamber. The anodes and the cathode are separated by a diaphragm which separates the anolyte chamber from the cathode and the catholyte chamber behind the cathode.

The anolyte chamber is largely filled with the sodium chloride solution, and upon electrolysis, chlorine gas is evolved at the anodes and alkali metal ions migrate to the cathode where aqueous sodium hydroxide solution is formed and withdrawn through the cathode interstices into the catholyte chamber from where it is recovered from the cell. Hydrogen is evolved at the cathodes and is collected in and withdrawn from the catholyte chamber.

The diaphragm usually is porous and readily permeable to electrolyte so that the electrolyte flows through the diaphragm and the foraminous cathode into the catholyte chamber and, in this case, the sodium hydroxide produced is substantially saturated with sodium chloride. These diaphragms are usually made of an asbestos layer which is formed by passing a water slurry of asbestos fiber through the cathode screen so that a thin layer of the fiber is collected thereon. In some cases, the diaphragm is a previously formed asbestos paper which is applied to the cathode. The diaphragm may be ion selective and more readily pass cations than anions. For example, it or the surface thereof may comprise a cation exchange material which restrains passage of chlorine ion into the catholyte but which passes alkali metal ion. In such a case, the diaphragm may be substantially impermeable to anolyte flow so that little water or chloride passes through the diaphragm and the sodium hydroxide produced and collected in the catholyte chamber is relatively pure, such as relatively free of chloride or chlorate.

The anodes comprise a hollow and foraminous conductive base of anode resistant metal such as metallic titanium, tantalum or other valve metals coated with a conductive surface of an anodically resistant electrocatalytic coating containing a platinum group metal or platinum group metal oxide. Other anodic surfaces such as magnetite, alkali metal or alkaline earth metal -- have been proposed.

Typical disclosures of foregoing types of cells are found in the following: U.S. Pat. Bianchi No. 3,491,014, Jan. 20, 1970; U.S. Pat. Smith No. 1,815,073, July 21, 1931; U.S. Pat. Baker et al. No. 2,987,463, June 6, 1961; U.S. Pat. Currey No. 3,432,422, Mar. 11, 1969; U.S. Pat. Loftfield No. 3,591,483, July 6, 1971.

Typical ion exchange or permionic or semi-permeable membranes or diaphragms and cells using such membranes for chlorine production are disclosed in the following: U.S. Pat. Hogdon No. 3,657,104, Apr. 18, 1972; U.S. Pat. Nielson No. 3,291,632, Dec. 13, 1966; U.S. Pat. Bodamer No. 2,681,320, June 15, 1954; U.S. Pat. Gibbs No. 3,624,053, Nov. 30, 1971; U.S. Pat. Leding No. 3,694,281, Sept. 26, 1972.

The disclosures of the foregoing patents are incorporated herein by reference.

The cells of the type described are often several feet in width, height and length. Thus, the pool of chloride solution is large in width and length and 1 to 2 feet or more in depth. Pluralities of anodes or anode elements opposite pluralities of cathode elements are provided in a cell unit of substantial volume adapted to produce one or more tons of chlorine per day.

In such large capacity cells which normally operate at high current density, it is important in terms of efficiency and trouble free operation to provide for a fast disengagement of the anodic gas from the electrolyte and for minimum variations of the electrolyte's concentration at the various levels of the cell. Some agitation of the electrolyte is generated by the rising gas bubbles. However, in these cells, the chlorine bubbles rise along the interelectrodic gap and inside the perforated hollow anodes with an almost uniform distribution throughout the entire cross section of the electrolyte pool. There is, however, no positive recirculation of the electrolyte from the upper level of the pool to the bottom of the cell. In fact, even though near the upper level of the electrolyte there is a considerable turbulence due to the summed effect of the evolved gas bubbles reaching the top, the electrolyte in the lower portion of the cell is not sufficiently agitated.

THE INVENTION

According to this invention, it has been found advantageous to provide special means and/or methods which tend to minimize or reduce variations in composition of electrolyte between the upper and lower levels thereof especially in the area between the electrodes. To ensure that a substantial volume of the electrolyte is positively recycled directly from the upper level to the lower level, for example, the bottom of the anolyte pool, lateral diversion of circulating electrolyte (or stray currents), which normally tends to occur as soon as occasional circulating channels are randomly formed in the pool, is restrained by providing non-porous (or low porosity) conduits (usually non-conducting or having an external non-conductive surface exposed to the anolyte) which extend from the upper level to the lower level of the electrolyte pool.

In this way, the chlorine bubbles rising in the electrolyte impart an upward movement to the mass of electrolyte outside the said conduits and a positive downward movement of electrolyte is thereby induced inside the conduits. A uniform recycling motion of the electrolyte is effectively generated and a continuous renewal of the electrolyte also in the lowermost portion of the electrolyte pool is obtained. An attendant benefit of the invention is also represented by the fact that the gas disengagement from the electrolyte is accelerated. In fact, stray and localized recirculation paths in the electrolyte are effectively eliminated and the gaseous chlorine bubbles are no longer diverted in their upward motion by these stray currents and furthermore a reduction of foam formation is also observed.

These conduits which can be viewed as vertical tubes open at the top and the bottom and extending from a point close to the upper level of the electrolyte in the cell to a point close to the bottom of the cell and are distributed uniformly along the entire cross section of the electrolyte pool in the cell to provide a plurality of spaced downward streams. These conduits should extend at least from a point close to the top of the anodes to a depth of at least 50% of the depth of the anodes, preferably to at least 90% of the depth of the anodes. In cells equipped with foraminous hollow anodes whose lower edge is usually spaced from the cell bottom, the conduits extend preferably for the entire height of the anodes.

They provide return downward flow of electrolyte unobstructed by upwardly rising chlorine bubbles, from a level adjacent the top of the anodes to a lower level adjacent the bottom of the anodes. Normally, however, they terminate above the bottom of the anode and in any event at a point sufficiently spaced from the cell bottom so that the cell bottom does not seriously impede or dam up the flow of the downward recycling electrolyte.

This invention is especially valuable when a pair of spaced anode surfaces are disposed between cathode fingers and when the anode surfaces are perforated as for example when the anodes are made of screen or reticulated metal so as to provide an interior space between the anode surfaces which is in free communication with the space between anode and cathode and which contains electrolyte. In this case, the electroconductive anodic surface may be on both sides of the screen, such as on the side facing the cathode surface and also on the opposite side thereof. Also the screen is provided with vanes or other flow diverters to divert flow of evolved gas bubbles through the anode screen and behind the anodic face nearest the cathode.

In such a cell, a large portion of the chlorine bubbles evolved by electrolysis are either generated on the interior side of the anode or are diverted to such interior. This provides for the rise of a large portion of gas bubbles in the interior area of the anodes and out of the space between anode and cathode. The rise of the gas bubbles tends to impart an upward momentum to the electrolyte contained also in the interior of the hollow anodes. However, for any upward motion imparted to a certain volume of electrolyte an equivalent volume of electrolyte is drawn downward and since the distribution of gas bubbles is substantially uniform within the interior of the anodes and in the gap between the anodes and cathodes and across the entire cross section of the electrolyte, random and localized recirculation paths are continuously formed and destroyed by interference of the streams with one another and a resultant turbulence which intensity increases many fold from the bottom of the cell to the top of the electrolyte, is observed. When the anode current density is relatively high such as above 1500 amperes per square meter or even as high as 3000 or more amperes per square meter gas evolution is more rapid and these effects are greatly increased.

By providing downcomer conduits in the anode interior or adjacent thereto, but between the cathode fingers, and downward flow of electrolyte to or near the cell bottom, substantial circulation of the electrolyte upwardly and thence downwardly takes place. A substantial upward flow of electrolyte is positively created by the upwardly rising chlorine bubbles and the chlorine bubbles are rapidly disengaged from the electrolyte and downward flow of equivalent volume of electrolyte takes place through the downcomer conduits.

It has been found that most satisfactory results are obtained when the total cross section area of the downcomer conduits is within the range of 20 to 60% of the total cross section area of the electrolyte pool. When the total cross section area of the downcomer conduits is less than 20% of the total cross section area of the electrolyte pool, the recirculation effect decreases markedly. Conversely, when the total cross section area of the conduits becomes larger than 0.6 times of the total cross section area of the electrolyte pool, the density of gas bubbles rising in the electrolyte outside the downcomer conduits becomes excessive and the gas bubbles tend to interfere with the passage of the electrolysis current and also their disengagement from the electrolyte near the top of the anodes begins to be retarded.

As there are a plurality of cathode fingers, the upward-downward circulation pattern is established in the space between each pair of cathode fingers and pluralities of spaced circulation paths of this character are produced each of which is open to brine above and below the cathode fingers. Thus the cell has a continuous pool of electrolyte with the upper and lower portions of the pool in communication with the spaced upward-downward flow patterns between the fingers. Circulation throught the cell is thus increased.

The invention herein contemplated may be effectively employed with both permeable and impermeable diaphragms. However, it is especially advantageous when employed in cells having permionic semi-permeable or impermeable diaphragms.

In the cells having permeable diaphragms, whether or not of cation exchange surface, substantial amount of anolyte flows through the diaphragm into the catholyte chamber. Thus there is positive flow through the portions of cathode opposite all active anode surfaces of the anode elements. The brine in the interelectrodic gap between anodes and cathodes is replenished during electrolysis and variations in composition are reduced and depletion of chloride concentration between the electrodes is at least partly avoided. With more impermeable or relatively non-porous diaphragms, flow through the diaphragm is reduced or does not take place to a substantial degree and thus the recycle herein comptemplated becomes especially advantageous to ensure uniformity in chloride concentration of the anolyte in the interelectrodic gap. This invention is applicable to diaphragm cells having permeable as well as semi-permeable or impermeable diaphragms.

The invention will be more fully understood by reference to the ensuing more detailed disclosure particularly with reference to the accompanying drawings in which.

Figure 2:
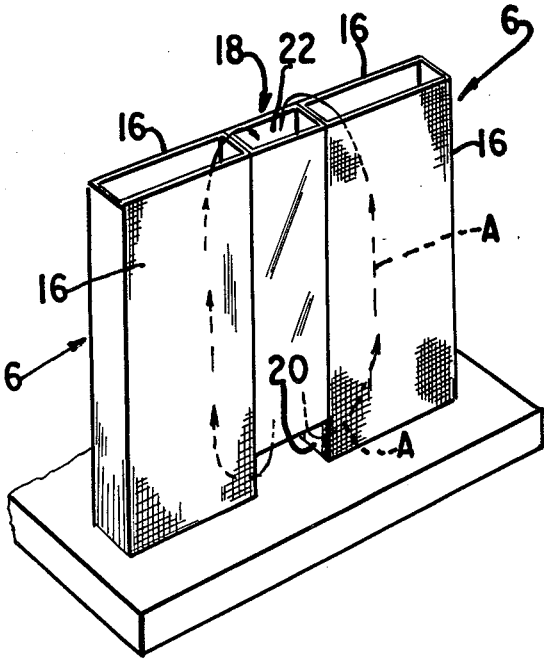
FIG. 2 is a diagrammatic fragmentary view of part of a cell base adapted for use in the cell of FIG. 1 upon which a typical pair of anode elements are mounted and provided with a type of recycling means contemplated by this invention.
Figure 2A:
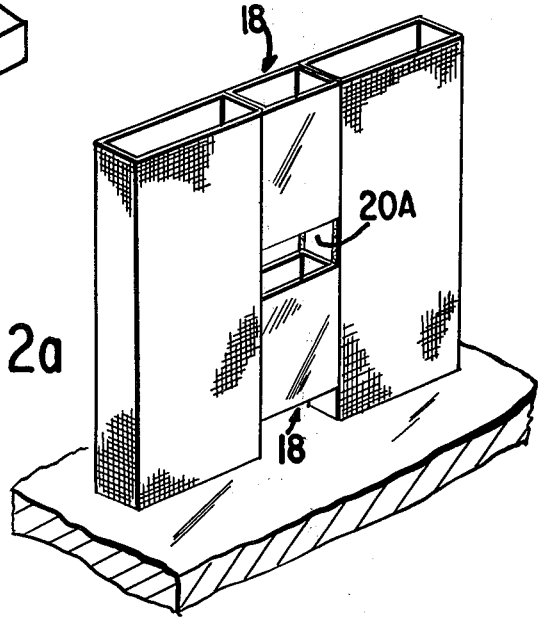
Figure 3:
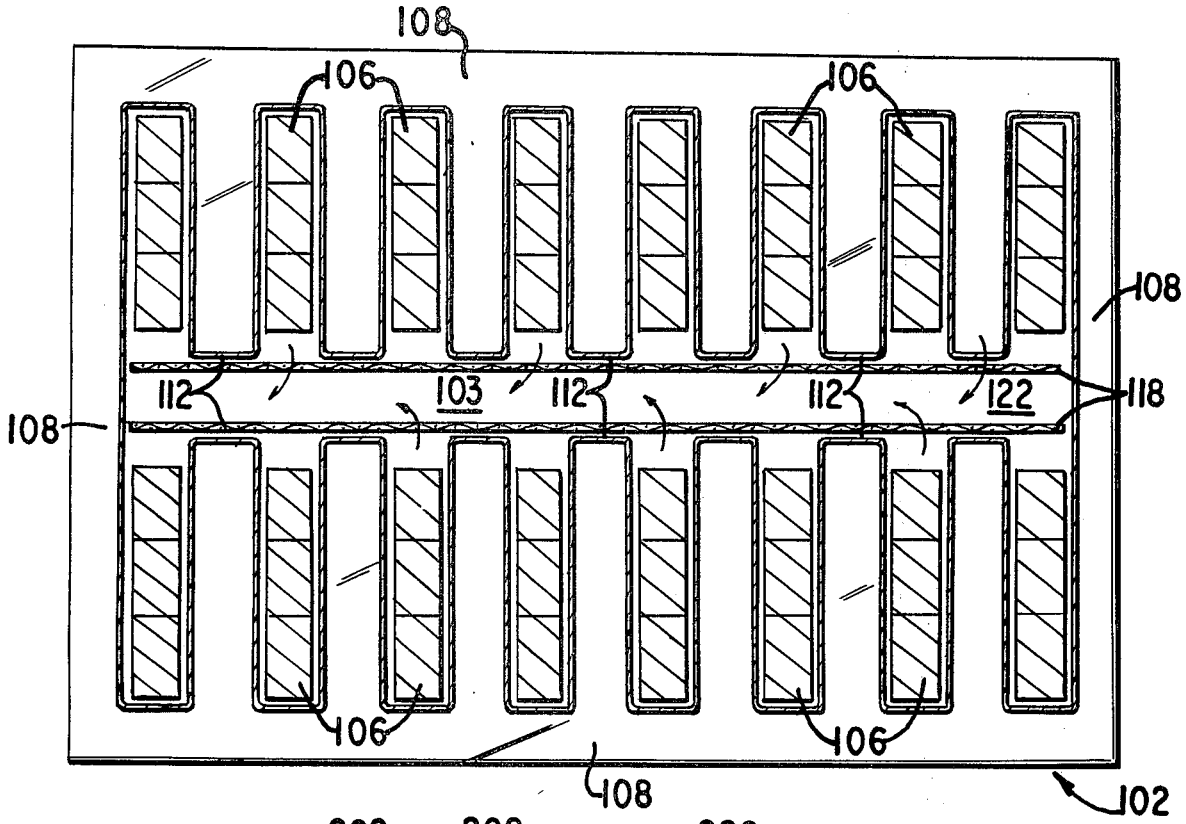
Figure 4:
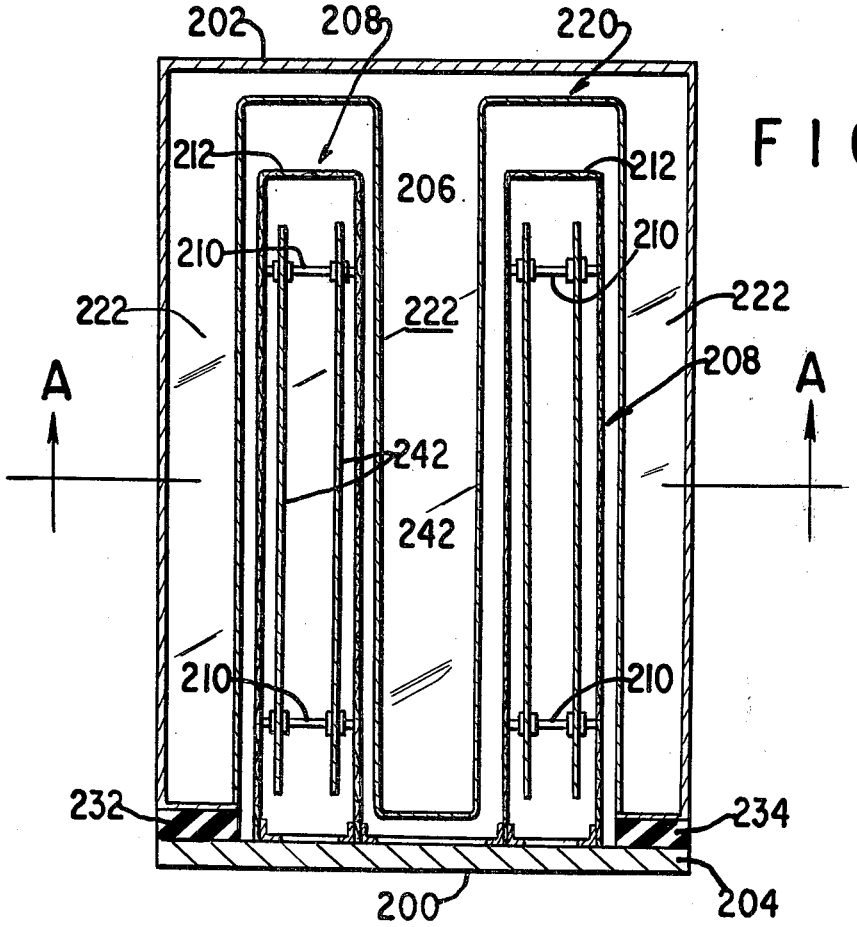

FIG. 2*a* shows a modification of the anode and downcomer means of FIG. 2;

FIG. 3 is a diagrammatic plan view of another type of cell cathode anode arrangement showing a different embodiment of the invention;

FIG. 4 is a diagrammatic plan view of a further type of anode-cathode arrangement showing a further embodiment of the invention; and FIG. 5 is a diagrammatic vertical sectional view of the cell illustrated in FIG. 4 taken along line A—A;

FIG. 6 is a diagrammatic side view of the anodes of another embodiment of this invention.

Figure 1:
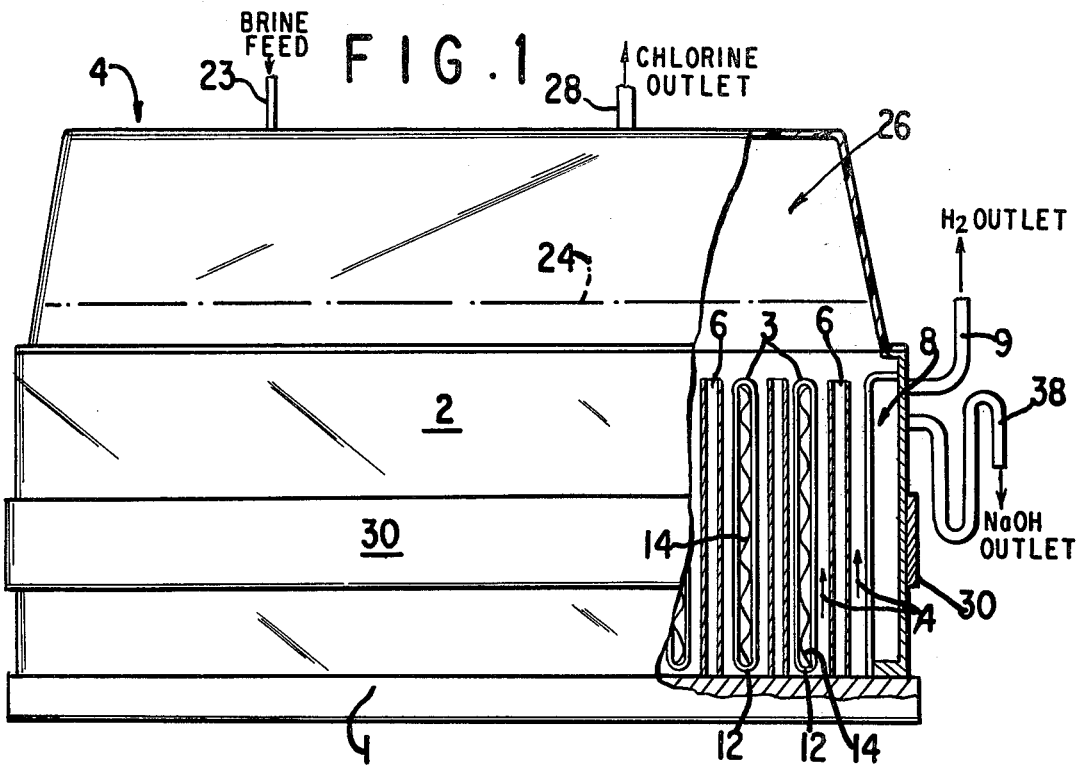
FIG. 1 is a diagrammatic side elevational partly in section of a cell to which this invention may be applied.

The cell illustrated in FIG. 1 comprises a cell base or anode base 1, a cathode can 2 resting on the base 1 and a cell cover 4 resting on the top of the cathode assembly. Appropriate seals to make the assembly liquid tight are not shown but are conventional. The base usually is constructed of steel or similar electroconductive material and current connectors (not shown) conduct positive DC current to the cell base and the anodes mounted thereon. Hollow screen cathodes 3 extend from hollow chambers 8 in each side of the cell can 2 and are provided with diaphragms.

Anodes 6 are anchored to the base 1 by suitable means and extend vertically in rows into the interior of the cell toward the cover 4. The base is covered with a suitable nonconductive mastic or rubber sheet which protects the base from the corrosive brine. The anodes 6 may be supported by a layer of lead which is poured and solidified about the anode slabs and covered with the mastic or the anodes may be supported by risers extending through the base and the risers may be secured to the base, the base being protected by a rubber blanket. See U.S. Pat. No. 3,591, 483.

The base rests upon insulation (not shown) so that the cell is effectively insulated from the ground.

The cathode can 2 encloses the interior section of the cell and comprises a hollow wall catholyte chamber 8 which extends entirely around the cell can 2 and has internal partitions in the form of cathode screens 3 having a diaphragm on the screen side facing the anodes 6. The cathode section thus comprises the enclosing chamber 8 and parallel hollow cathode fingers 12 which extend across all or a portion of the central area enclosed by the cell can 3 and open at their ends into the hollow wall chamber 8. They are relatively narrow elongate cathode structures 12 which may project across the central area from one side to the other or may terminate in a central zone as diagrammatically illustrated in FIG. 3. (See fingers 112). In any event, they are formed of foraminous metal, usually iron in the form of screen or perforate iron, with the asbestos or other diaphragm deposited thereupon or applied thereto. The fingers may be internally reinforced by a corrugated iron sheet 14. The cathode fingers 12 are spaced from the bottom of the cell.

As shown in FIG. 1, anodes or anode elements 6 project upward from the base 1 into the spaces between the cathode fingers 12. These anodes may comprise rows of box-like reticulated metal structures or spaced metal sheets with a conductive anodically resistant electrocatalytic coating on the faces opposing the cathode screens or on the inner core of the box-like anode structures and are disposed in rows of individual flat surface elements in edge to edge alignment, the rows being spaced from each other and extending substantially along the length of the relatively narrow spaces between the cathode fingers but spaced from such fingers.

FIG. 2 diagrammatically illustrates one embodiment of anode elements 6 which are anchored to base 1 and which may be employed in the cell of FIG. 1. As shown in FIG. 2 a pair of upright metal anodes having conductive faces 16 on each side are mounted essentially perpendicularly on base 1 and in electrical contact with the metal base. The base may be insulated by an insulating coating (not shown) of rubber mastic or the like on the upper side thereof. The anode structures 6 are of elongated rectangular box-like structure with a pair of parallel faces 16, such faces may be of screen or perforated sheet and may be provided with an electrically conducting electrocatalytic coating on either the exterior or interior face or on both faces. The row of such anode elements extends along and close to a cathode screen or finger 12, such as between a pair of fingers. The bottom of the anodes may, if desired, be spaced from the non-conductive layer on base 1.

The anode elements 6 are spaced from each other along the row and the finger by preferably imperforate hollow spacing conduits 18. The anode current density may be substantially higher than cathode current density and the active area of the anode surface may be smaller than the area of the cathode screen.

While only one row or partial row of anodes is shown in FIG. 2, it is to be understood that spaced rows of such anodes are mounted on base 1, so that the anode rows 6 alternate and interleave with the spaced cathode fingers 12 and provide anodic surfaces opposite each cathode finger surface as well as opposite the two half cathodes at each end of the cell of FIG. 1. The rows may comprise more than two spaced aligned anode elements 6.

The space between the spaced anode elements 6 is completely enclosed by non-conductive square conduit 18 which may be attached to the anodes or may be internally supported by a support channel or pipe member (not shown) within the enclosure and extending up from and anchored to or in the base.

The upper edge of the conduit 18 is approximately at the level of the top edge of the anodes 6. However, it may be somewhat lower or higher than such top anode edge if desired. The lower edge of the conduit 18 terminates above the bottom 1 to provide a space or opening 20 at the bottom of the enclosed interior 22 of the downcomers 18.

The construction provides a conduit or space 22 with a bottom outlet 20, which is essentially enclosed to the electrolyte which is rising in the anodes 6 because of gas lift of evolved chlorine, so that the electrolyte circulates up through the hollow anodes 6 and down through the conduits 18, with the walls of anodes 6 and conduits 18 restraining lateral flow so that the bulk of electrolyte entering the top of the conduits 18 is delivered at or near the bottom of the cell or at least adjacent a lower part of the anodes. The bottom outlet 20 of the conduit 18 should be sufficiently spaced from the cell bottom to prevent the cell bottom from slowing the flow of brine from the conduit outlet 20, a distance of 5 to 10 centimeters between the cell bottom and the conduit outlet is usually sufficient.

In operation, the alkali metal chloride solution is fed into the top of the anolyte chamber by conventional feed means 23 and the electrolyte level in the chamber is maintained at a level above that of the cathode screens and the anodes, for example as indicated at 24. The cell cover 4 which may be of any suitable plastic non-conductive corrosion resistant material rests on the top of the cell can 2. Frequently, but not necessarily, the electrolyte level is above the bottom of the cover which is fitted in a liquid tight manner on the cell can. When porous diaphragms are used the electrolyte level may be permitted to rise to compensate for any plugging of the diaphragm in use and to maintain a sufficient hydrostatic electrolyte head to insure flow through the diaphragms. The electrolyte level is in any event, held below the top of the cover but above the electrodes so as to provide a gas space 26 above the electrolyte for collection of chlorine gas.

As the brine solution is fed into the anolyte chamber a direct current electric potential of about 3–5 volts is established between the anode base 1 and the cathode assembly 3. The cell can 2 is provided with a copper grid bar 30 which is in contact with and extends around the cathode assembly and is connected to the negative pole of the DC source.

Because of the difference in hydrostatic pressure between the anolyte chamber and the hollow interior of the catholyte chamber 8 and the cathode fingers 12, brine flows through the diaphragm and the cathode screen into the chamber 8. Sodium hydroxide and hydrogen are formed at the cathode surfaces and carried into the interior of the fingers 12 and to chamber 8. Hydrogen is withdrawn from the top of the chamber through a port or ports diagrammatically illustrated at 9. Sodium hydroxide is withdrawn through conventional outlets 38 adapted to control liquid level within the catholyte chamber 8 and the cathode fingers at a convenient level.

Chlorine gas is evolved on the anode surfaces 16 in the form of bubbles which rise as a bubble stream extending from the bottom to the top of both the interior and exterior anode surfaces 16 as shown by arrows A in FIGS. 1 and 2. These bubbles ultimately rise to the gas space 26 where chlorine gas is collected and withdrawn through the conventional outlets 28. When the anode is of screen or other perforated or reticulated structure some of the evolved chlorine gas is diverted into the interior of the anodes 6. By providing the anode with vanes, fins or other channeling means (not shown) a large part of such gas may be diverted to the interior of the anode 6.

As the bubbles rise through the relatively narrow space between anode and cathode surfaces and within the anode interior, chloride solution (brine) is caused to move upwardly by gas lift. This brine solution ultimately rises to the top of anodes 6 and the upward brine flow produces a downward brine flow through the conduits 18 ultimately delivering brine to the bottom of the conduits 18 and out through opening 20 adjacent the bottom of the space between the anode and cathode as indicated by arrows A.

This circulation produces a positive transfer of electrolyte from the top to the bottom and bottom to the top of the electrolyte pool thus reducing the possibility of localized sodium chloride depletion in localized areas between electrodes. Fresh brine is added to the cell to make up for the volume percolating through the diaphragms or the anolyte is continuously withdrawn from the cell, resaturated and circulated back into the cell to maintain the brine saturated or essentially so in cells operating with impermeable permionic diaphragms.

This same upward, downward circulation takes place within each space enclosed or partially enclosed by a pair of cathode fingers or spaced cathode screens. Consequently, the positive circulation takes place from the top to the bottom and vice versa in a plurality of circulating streams flowing in substantially parallel spaced relationship in close association with the electrodes. Since the level of the electrolyte or brine is above the anodes 6 and the cathodes 12 these circulation patterns are separate from each other but communicate with or are exposed to the body of brine in the cell above the anodes and below the anodes where the anodes and cathode fingers are spaced from the cell bottom.

Foam which may form at the top of the anodes tends to be broken up by the lateral flow from the top of the anodes 6 to the top of downcomers 18 and from the space over the electrodes to the space over conduit 18.

As illustrated in FIG. 2 the downcomers 18 extend from the top to near the bottom of the space between the anodes and cathodes. However, it is not essential to provide such a long conduit. For example, the conduit may terminate below the top of the anode surface and may also terminate well above the bottom so as to provide unobstructed flow into the electrolysis space.

Also, the conduits may comprise several spaced subconduits which extend along only part of the anode and are spaced to permit flow from the conduit to intermediate levels between anode and cathode as shown by dotted lines as intermediate opening 20A in FIG. 2*a*.

In all events however, the conduit 22 provides a zone where downward flow is promoted over a substantial depth generally not less than 50 to 75 percent and preferably in excess of 80 percent or more often at least 90 percent of the depth of anode immersion such as the height of the active anode surface. While some lateral or essentially horizontal flow may be permitted over such depth, the partitions substantially restrain lateral flow and promote the bulk of the flow in a vertical direction between the various cathode elements and over a substantial depth of the brine pool. The total cross section area of the conduits 22 is preferably comprised in the range of 0.2 to 0.5 (i.e. 20 to 60%) of the total cross section area of the electrolyte pool in the cell.

FIG. 3 diagrammatically illustrates a further embodiment, in which a cathode assembly 102 provided with hollow cathode fingers 112 extends in toward a central chamber 103 but does not extend across the cell. The bottom of the fingers 112 are spaced from the cell floor as illustrated in FIG. 1. Thus, the fingers terminate to provide the central circulation space 103 which is unobstructed by anodes or cathode elements. The cathode fingers 112 are open at their rear to the circumferential enclosing chamber (catholyte) 108, similar to the hollow wall chambers 8 in FIG. 1. Anodes 106 which may be graphite slabs or metal structures of the type described in connection with FIGS. 2 and 2*a* above are mounted on the cell base and disposed side by side in rows between the cathode fingers. An electrolyte space is provided between, above and below the cathode fingers 112.

In the central area and adjacent to the terminal point of the fingers 112, partitions 118 are provided so as to establish a passage area 122 through which the electrolyte is circulated downward toward the bottom of the cell. These partitions terminate (as in the embodiment shown in FIG. 2) above the cell bottom to provide a cell outlet comparable to outlet 20 in FIG. 2. Thus a circulation similar to that described above is established upward inside the hollow anodes and/or within the interelectrodic gap if the anodes are solid slabs and downward inside the central channel 122.

FIG. 4 diagrammatically illustrates a plan view of an embodiment of a cell unit in which the anode elements and the cathode elements extend horizontally from opposite ends of the cell. This cell unit has an anode end 200 and a cathode end 202. The anode end comprises end wall 204 of electroconductive material such as titanium metal, rubber coated steel or the like and mounted vertically on a base (230, FIG. 5) providing the cell floor. The base may be steel, coated on its upper side with rubber, mastic or other non-conductor material.

Anodes 208 comprise a pair of spaced anode elements in the form of perforated metal sheet, screen or reticulated mesh, 206 such as titanium, tantalum or other value metal, having at least on the side facing the cathodes an anodically insoluble conductive electrocatalytic surface or coating, for example, ruthenium oxide, platinum metal or other platinum group metal or other conductive electrocatalytic coating. These anode sheets project horizontally from the vertical end wall 204 and are welded or otherwise fastened thereto. They are held in place by spacer support members 210 welded or otherwise fastened to the sheets. The assembly conveniently may be provided with an anodic end mesh section 212 which opposes the ends of recesses between the cathode elements. While only two anode assemblies are shown in the drawing it will be readily understood that many more may be provided.

The cathode section comprises a vertical end chamber 220 from which hollow cathode fingers 222 project horizontally between the anodes and on the outside thereof. These fingers present diaphragm coated cathode screens opposite the active areas of the anode elements with external portion of the outer fingers providing the side walls of the cell unit and the interior fingers projecting between individual spaced anodes 208.

The cell unit is made liquid tight by the gaskets or sealer 232 and 234 respectively between the base and the outside cathode fingers 222 and between the ends of the outer cathode fingers abutting the end wall 202 and the vertical anode end wall 204. The cell also is provided with a liquid tight cover 238 (FIG. 5) and chlorine exit 249. Conventional means not shown are provided to feed brine to the cell and to withdraw brine and alkali hydroxide therefrom.

The anodes and central cathode fingers are spaced from the floor 230 and means are provided to establish a brine level within the cell anolyte chamber above the level of the anode elements and the cathode screens. Anode side walls 206 preferably terminate at or slightly below the cathode screen of the cathode fingers 222.

Within the space between anode sheets 206 are disposed two spaced vertical baffle members 242, usually having a non-conducting external surface which is resistant to corrosion, such as titanium metal, rubber coated steel, synthetic resin sheet, etc. These baffles provide a vertical channel within the anode space extending from an upper level of the space, usually at or near the upper ends of anode elements 206, to a lower level frequently at or near the lower ends of the anode elements.

In the operation of the cell, brine is introduced and flows between anode and cathode faces and through the cathode screen in the usual manner of function of diaphragm cells. By establishing a direct current electrical potential between the anode and cathode ends of the cell, electrolysis occurs and sodium hydroxide and hydrogen are produced at the cathode and withdrawn into the interior of the cathode fingers and thence to chamber 220 where they are removed from the cell in a conventional manner.

At the same time, gaseous chlorine evolves on the anode elements and rises between the elements and the fingers creating brine movement as shown by the arrows in FIG. 5. Some portion of the chlorine bubbles is diverted through the anode mesh or perforations and rises at least at the upper part of the anode elements on the side of the anode elements away from the cathode such as between the spaced elements 206. This gas rise produces upward brine flow as discussed above. By providing an electroconductive anode resistant coating of a platinum group metal or oxide on the side of screens 206 which is remote from the cathode, chlorine gas also may be generated within the space enclosed by the screen 206 thus ensuring gas rise and consequent electrolyte rise in that space.

Concurrently, brine flow takes place downward between the baffles 242 and the downward flowing brine is delivered to a lower level between the anode space and is caused to flow through the anode openings as well as underneath such anode elements as shown by the arrows. Thus the type of circulation pattern discussed above is established.

The baffles may have intermediate openings between the ends thereof to provide intermediate outlets as discussed in conjunction with the embodiment illustrated in FIG. 2.

It will be understood that this invention may be applied to many other types of cells. It may be especially advantageously applied to cells having cation exchange diaphragms which are impermeable to brine flow or which at least restrain brine flow and chloride transfer across the diaphragm. Employing such diaphragms, it is possible to produce sodium hydroxide solution which may contain less than five percent, often as low as 0.05 percent to one percent by weight or even less of sodium chloride on the anhydrous basis; the ultimate chloride concentration depending upon the extent of brine flow through the diaphragm or upon the extent of chlorine ion transfer through the diaphragm.

Because of the reduced brine flow through the diaphragm, in these cases, the upward-downward flow pattern of brine generated according to this invention becomes more important in establishing uniformity of brine concentration. The composition of cation exchange diaphragms or diaphragms which restrain chloride transfer across the diaphragm is itself well known. Commonly it comprises a sheet of a cation exchange material or resin or a fibrous base, such as asbestos or fiberglass coated with such material. Resins which are suitable include: styrene-maleic anhydride copolymers, trifluro-vinyl-sulfonic acid polymers and others such as those identified in the foregoing patents.

FIG. 6 illustrates a further embodiment in which a rectangular box-like anode screen or cage 300 provided with the usual conductive electrocatalytic coating containing a platinum group metal or platinum group metal oxide coating is supported by a central riser 301 which is connected to the cell base 302. The bracket is welded to the screen and to the riser and provides support and bracing for the screen.

The riser 301 is anchored to the base 302 of a cell and has a flange 315 which rests against a non-conductive cover 316 on the cell base 302 substantially as illustrated in U.S. Pat. No. 3,591,483 referred to above. The anode cage is thus supported above and spaced from the cell floor. A plurality of the cages 300 is usually used across each anode row in a cell.

Within the interior of the cages 300 hollow pipes 319 are mounted on the floor of the cell or welded within the cages 300 and extend up to an inlet 319*a* near the top of the anode cages 300. The pipes are provided with lateral outlets 321 in the sidewall of the conduit near the lower part of the anode cage to permit free outflow of brine downwardly flowing through the pipe.

The upward-downward circulation thus takes place within the enclosed area of the anode cages 6 substantially as discussed in connection with the embodiment of FIGS. 4 and 5.

The invention may be subjected to numerous variations. For example, while the invention contemplated here is primarily concerned with the production of sodium hydroxide, sodium carbonate may be produced particularly where a semipermeable membrane is used as a diaphragm. In that case, flow of anolyte through the diaphragm is held low or is essentially avoided and water must be introduced into the catholyte chamber to recover the sodium hydroxide formed at the cathode. By introducing as aqueous solution of sodium bicarbonate in lieu of water into the catholyte chamber, sodium carbonate is produced. Also sodium bicarbonate or a sodium carbonate-sodium bicarbonate mixture may be obtained by introducing water and carbon dioxide (carbonic acid) into the catholyte chamber.

Alkaline alkali metal compounds of other alkali metals may be produced by using, in lieu of sodium chloride, chlorides of other metals, such as potassium or lithium. Other halides of alkali metals such as potassium bromide or potassium may be electrolyzed in this manner.

Although the present invention has been described with reference to the specific details of certain embodiments thereof, it is not intended that such details shall be regarded as limitations upon the scope of the invention except insofar as included in the accompanying claims.

We claim:

1. In the process of producing chlorine by electrolyzing aqueous alkali metal chloride solution in an electrolytic cell between a hollow anode located between a pair of cathode surfaces and open at its top and lower ends, the improvement which comprises generating between said cathode surfaces and said anode, during said electrolysis, upward circulation of solution toward the top of the solution in both the hollow interior of the anode and in the spaces between the exterior of the anode and the adjacent cathode surfaces, and downward movement of the solution from an upper level of said solution to a lower level thereof through electrically non-conducting passages substantially free of gaseous halogen within said hollow anode.

2. The process of claim 1 wherein the downward flow is in a passage between said pair of anode surfaces which are not involved with the upward flow of chlorine bubbles generated at the anode.

3. A process of electrolyzing a pool of an aqueous solution of alkali metal halide in an electrolytic cell to liberate gaseous halogen within said cell and form alkali metal hydroxide and hydrogen, which comprises conducting said electrolysis between a plurality of hollow anodes, open at their tops and lower ends, which have conductive surfaces facing a plurality of cathode surfaces, immersed in said pool and separated by a diaphragm, whereby to evolve gaseous halogen which rises in the solution in the interelectrodic gap between the anodes and cathodes and in the hollow interior of said anodes creating upward movement of the solution toward the top of said pool, flowing solution downward within said cell through electrically non-conducting passages substantially free of gaseous halogens in the interior of the anodes from an upper level to a lower level of said pool, and returning the downward flowing solution to said pool.

4. The process of claim 3 wherein the halide is a chloride and the downward flow is conducted in a plurality of spaced passages, each passage being inside a different anode surface.

5. The process of claim 4 wherein the downward flow is directly to a depth in the solution at least 50 percent of the depth of immersion of the anode in said solution.

6. The process of claim 4 wherein the chloride permeability of the diaphragm is low enough to hold alkali metal chloride concentration in the alkali metal hydroxide formed below one percent by weight on the anhydrous basis.

7. The process of claim 3 wherein the electrolyte is caused to flow downwardly through a passage bonded by at least a pair of impervious non-conducting surfaces.

8. The process of claim 7 wherein lateral flow of the downward flowing solution is restrained.

9. The process of claim 3 wherein the diaphragm includes a cation exchange material.

10. The process of claim 3 wherein there are a plurality of spaced downwardly flowing passages in the interior of said anodes.

11. An electrolytic alkali halogen cell which comprises a plurality of spaced hollow anode elements extending in parallel relationship from a common anodic conductor, a plurality of foraminous cathode elements interleaved between anode elements, a diaphragm between cathode and anode, means to impose an electric potential between anode and cathode, means to maintain a pool of aqueous alkali metal chloride brine in the cell whereby upon electrolysis of the brine, chlorine gas is evolved at the anode and rises in the brine between pairs of cathode elements and causes upward brine movement toward the top of the pool, and means inside said hollow anodes for positively recycling brine downward from an upper level of the pool directly to a lower level thereof.

12. The cell of claim 11 wherein the recycling means are vertical tubular elements open at the top and bottom and extending from a level close to the top of the pool of aqueous alkali metal chloride solution to a level close to the bottom of said pool inside said hollow anodes.

13. The cell of claim 12 wherein the recycling means extends vertically for a depth which is not less than 50 percent of the depth of immersion of the anodes.

14. The cell of claim 12 wherein the total cross section area of the recycling means is comprised between the range of 20% to 60% of the total cross section area of the pool of aqueous alkali metal chloride solution contained in the cell.

15. The cell of claim 11 wherein the recycling means is at least one vertical chamber defined by at least two parallel vertical substantially impervious baffles extending vertically from a level close to the top of the pool of aqueous alkali metal chloride solution to a level close to the bottom of said pool inside said hollow anodes.

16. The cell of claim 15 having a plurality of said anode surfaces each of which is associated with an individual recycling means.

17. The cell of claim 11 wherein there are a plurality of spaced recycling means disposed between a pair of cathode surfaces and inside said hollow anodes.

18. The cell of claim 11 wherein there are a plurality of spaced recycling means, each being disposed between a pair of anode elements and inside said hollow anodes.

19. An electrolytic alkali chlorine cell which comprises an anolyte chamber separated from a catholyte chamber by a diaphragm, said anolyte chamber being adapted to contain a pool of aqueous alkali metal chloride solution, hollow anode elements disposed below the top of the pool and opposite cathodic surfaces whereby as gaseous chlorine is evolved upon electrolysis at a surface of said anode elements, the chlorine rises and tends to cause upward movement of the solution, and recycling means inside said hollow anodes having a surface which is less electroconductive than said anode surface to convey solution downward toward the bottom of said pool.

20. An electrolytic alkali chlorine cell which comprises a cell having anolyte and catholyte chambers, hollow anode elements in substantially vertical spaced relation in the anolyte chamber, foraminous cathode elements bounding the catholyte chamber and a diaphragm separating said chambers, means for feeding aqueous alkali metal chloride electrolyte into the anolyte chamber, means to impose an electric potential between cathode and anode elements whereby upon electrolysis of the aqueous chloride, gaseous chlorine is evolved on surfaces of the anode elements and rises along the hollow anode elements in the electrolyte tending to cause upward electrolyte movement toward the top of the anode surface, and recycling means inside said hollow anode elements restraining lateral movement of the recycle electrolyte adjacent the anode surfaces to recycle electrolyte from an upper level thereof downward to a lower level thereof.

21. The cell of claim 20 wherein the recycling means is a substantial non-conductor.

22. The cell of claim 20 wherein said recycling means conveys electrolyte from a level adjacent the upper portion of said anode surfaces to a level adjacent the bottom of said surfaces.

23. The cell of claim 20 wherein the anode surfaces are horizontally aligned between the cathode elements and the recycling means is a conduit inside said hollow anode elements for recycling electrolyte which extends downward from an upper level of the electrolyte to at least a level adjacent the lower portion of the anode surfaces.

24. The cell of claim 20 wherein the recycling means is between a pair of anode surfaces.

25. The cell of claim 20 wherein said cell is provided with a plurality of individual recycling means each being inside separate individual anode elements.

26. The cell of claim 20 wherein said cell is provided with pluralities of pairs of said anode elements with recycling means between said pairs of anode elements.

27. An alkali chlorine cell comprising a plurality of cathode fingers, a plurality of spaced hollow anode elements between said fingers, a diaphragm between cathode fingers and the anode elements dividing the cell into an anolyte chamber containing the anode elements and catholyte chambers behind the cathode fingers whereby when an electric potential is applied between the anode elements and the cathode fingers with an aqueous alkali metal chloride electrolyte in the anolyte chamber, chlorine gas is formed and rises along the anodes in the electrolyte creating upward movement of electrolyte, and means inside said hollow anode elements and between said fingers to direct downward flow of electrolyte in the anolyte chamber.

28. The cell of claim 27 wherein said means has a substantially non-conductive external surface exposed to the alkali metal chlorine.

29. The cell of claim 27 wherein the diaphragm is low enough in permeability so that flow of anolyte therethrough is impeded.

30. The cell of claim 27 wherein the diaphragm is sufficiently impermeable to ensure production of sodium hydroxide containing less than 0.5 percent chloride by weight on an anhydrous basis.

31. An alkali chlorine cell having a foraminous cathode and a hollow anode, a diaphragm between the anode and cathode dividing the cell into an anolyte chamber and a catholyte chamber whereby when an electric potential is imposed between anode and cathode with aqueous alkali metal chlorine electrolyte in the anolyte chamber, gaseous chlorine is evolved at the anode surface and rises in electrolyte toward the top of the cell creating upward flow of electrolyte, and means inside the hollow anode to convey electrolyte from an upper level of the cell downward to a lower level in said cell, said means restraining lateral flow of said electrolyte during said downward flow.

32. The cell of claim 31 wherein the means is adapted to convey electrolyte downward to a depth at least 50 percent of the total depth of anode immersion in the electrolyte.

33. The cell of claim 31 wherein the surface exposed to electrolyte of the means to convey electrolyte downward is a non-conductor.

34. An electrolytic alkali chlorine cell which comprises an anode disposed between a pair of cathode surfaces, said anode presenting a pair of spaced perforated surfaces opposite said pair of cathode surfaces with an interior space therebetween so that electrolyte between the anode and cathode has access to the interior of the anode between said spaced anode surfaces, said perforate anode surfaces being adapted to divert evolved chlorine to said interior space and at least a conduit between said pair of cathode surfaces capable of conveying electrolyte from an upper level to a lower level thereof and of restraining lateral electrolyte flow during said conveyance.

35. An alkali chlorine cell comprising: a plurality of spaced upright cathode fingers, spaced pairs of upright perforate anode surfaces, extending upward along but spaced from the cathode fingers each said spaced pair of anode and surfaces being between a pair of cathode fingers and providing an interior space between the spaced pair of anode surfaces, means to cause evolved chlorine to rise in the interior spaces whereby to generate upward electrolyte movement, means to maintain the level of electrolyte in the cell above the level of the fingers, the space between the fingers being open to the body of electrolyte above said fingers and chlorine rising in said interior spaces is open to rise through said body, and electrolyte conduits between each pair of adjacent cathode fingers providing a downward path unobstructed by rising chlorine and extending from an upper to a lower level of the cell, said conduits being open to electrolyte flow to both said upper and lower levels of the cell the lower outlet thereof being adjacent the lower end of said finers.

36. The cell of claim 35 wherein the conduits extend down a distance at least 50 percent of the dept of anode immersion in the electrolyte.

37. The cell of claim 35 wherein the anode surfaces are provided with means to divert evolved chlorine to said interior spaces causing evolved chlorine to rise in the interior spaces between the spaced pairs of anode surfaces.

* * * * *